United States Patent [19]

Mattison et al.

[11] Patent Number: 4,592,416

[45] Date of Patent: Jun. 3, 1986

[54] MODULAR TUBULAR HEAT EXCHANGER

[75] Inventors: Glenn D. Mattison, Wellsville; Michael A. Case, Scio, both of N.Y.

[73] Assignee: The Air Preheater Company, Inc., Wellsville, N.Y.

[21] Appl. No.: 728,115

[22] Filed: Apr. 29, 1985

[51] Int. Cl.[4] ..... F28F 7/00

[52] U.S. Cl. ..... 165/83; 165/78

[58] Field of Search ..... 165/76, 78, 81, 83

[56] References Cited

U.S. PATENT DOCUMENTS

| | | | |
|---|---|---|---|
| 2,487,626 | 11/1949 | Wittman | 165/82 |
| 2,729,433 | 1/1956 | Berg | 165/78 X |
| 3,313,274 | 4/1967 | Hendrix | 165/78 X |
| 4,253,516 | 3/1981 | Giardina | 165/78 |

*Primary Examiner*—Stephen F. Husar

*Attorney, Agent, or Firm*—William W. Habelt

[57] ABSTRACT

A heat exchange apparatus (10) formed of a plurality of heat exchange modules (20) mounted together in side-by-side relationship to form a box-like array. Each heat exchange module (20) houses a multiplicity of heat exchange tubes (44) which provide a flow passage through which a first heat exchange fluid, such as air, is passed in heat exchange relationship with a second heat exchange fluid, such as flue gas, passing through the heat exchange apparatus over the heat exchange tubes. Each heat exchange module (20) is comprised of a rectangular box-like support frame (30) formed of a pair of spaced apart end frames (**32*a*,32*b*) interconnected at their respective corners by longitudinally elongated support members (34*a*,34*b*), a tube bundle assembly (40) disposed within the support frame, and attachment means (50,50') for mounting the tube bundle assembly to the support frame, the attachment means (50') including expansion means (52) for accommodating translational movement of at least one tube sheet (42*a***) of the tube bundle assembly within the support frame as the heat exchange tubes of the tube bundle assembly expand or contract longitudinally.

8 Claims, 5 Drawing Figures

MODULAR TUBULAR HEAT EXCHANGER

BACKGROUND OF THE INVENTION

The present invention relates to recuperative heat exchangers, and more particularly, to tubular heat exchangers of the type wherein a heating fluid is passed over a plurality laterally adjacent heat exchange modules arranged in a box-like array, with each module housing a plurality of heat exchange tubes through which a fluid to be heated is passed in heat exchange relationship with the heating fluid.

In a typical recuperative heat exchanger of the type to which the invention pertains, a number of heat exchange modules are disposed in a box-like array, laterally adjacent to each other. Each heat exchange module comprises a plurality of longitudinally disposed tubes mounted at their opposite ends to apertured tube sheets. The fluid to be heated passes through the heat exchange tubes of the modules in heat exchange relationship with the heating fluid which is being passed through the array of heat exchange modules in cross flow over the outside of the heat exchange tubes.

A major advantage of the modular concept of construction for recuperative heat exchangers lies in the simplified field erection associated with the modular construction. Recuperative heat exchangers are generally rather large structures often having a height of more than ten meters and a width of more than fifteen meters. To field erect such a structure from scratch is a very labor extensive, time-consuming task and, therefore, costly. By constructing a recuperative heat exchanger of pre-assembled, shippable modules, both field erection and transportation are simplified and costs reduced.

Typical prior art modular tubular heat exchangers of the recuperative type are exemplified by the heat exchangers of U.S. Pat. Nos. 2,487,626; 2,653,799 and 4,202,407. Each of these heat exchangers is formed of a plurality of tubular heat exchange modules disposed in a stacked array of one or more columns. Each individual module is comprised of a plurality of longitudinally disposed tubes extending between and mounted to a pair of spaced tube sheets. Laterally adjacent modules are attached to each other by securing their flanged tube sheets together by bolting, pinning or welding. In each case, the tube sheets of the individual modules in the array are linked together to form the support structure of the heat exchanger. Therefore, it is difficult to remove any single module for service or replacement without jeopardizing the structural integrity of the remaining structure.

Accordingly, it is an object of the present invention to provide an improved modular tubular heat exchanger whereby the removal of individual tube bundles may be accomplished without effecting the structural integrity of the heat exchanger.

It is an additional object of the present invention to provide a tubular heat exchange module whose construction facilitates shipment, field erection, and field servicing.

SUMMARY OF THE INVENTION

A heat exchange apparatus formed of a plurality of heat exchange modules mounted together in side-by-side relationship to form a box-like array. Each heat exchange module houses a multiplicity of heat exchange tubes which provide a flow passage through which a first heat exchange fluid, such as air, is passed in heat exchange relationship with a second heat exchange fluid, such as flue gas, passing through the heat exchange apparatus over the heat exchange tubes.

In accordance with the present invention, a heat exchange module is comprised of a rectangular box-like support frame formed of a pair of spaced apart end frames interconnected at their respective corners by longitudinally elongated support members, a tube bundle assembly disposed within the support frame, and attachment means for mounting the tube bundle assembly to the support frame, the attachment means including expansion means for accommodating translational movement of at least one tube sheet of the tube bundle assembly within the support frame as the heat exchange tubes of the tube bundle assembly expand or contract longitudinally.

In the preferred embodiment of the tube bundle assembly, the attachment means comprises a metallic strip having at least one flexible fold intermediate its ends which serves as an expansion means to accommodate transitional movement of the tube sheet relative to the end frame member which it laterally abuts. To mount the tube bundle assembly to the support frame, one end of the metallic strip is welded to the tube sheet of the tube bundle assembly while the other end of the metallic strip is welded to the end frame member of the support frame laterally abutting the tube bundle assembly.

To construct the heat exchanger apparatus, a plurality of individual heat exchange modules are stacked one atop the other in one or more laterally adjacent columns to form a box-like array. The support frames of abutting heat exchange modules are linked together to form the structural support skeleton for the heat exchanger thereby providing the structural integrity for the heat exchanger. The tube bundle assemblies are readily removed from their individual support frames by disconnecting the attachment means from the end frame of the support frame and simply sliding the tube bundle assembly out of the support frame for serving or replacement. Additionally, as each tube bundle assembly is premounted within a support frame at its manufacturing site, the support frame itself serves as a shipping cradle to protect the tube bundle assembly during shipment to the erection site.

BRIEF DESCRIPTION OF THE DRAWING

A better understanding of the present invention may be obtained from the following description of a preferred embodiment thereof taken with reference to the accompanying drawing.

DESCRIPTION OF A PREFERRED EMBODIMENT

Figure 1:
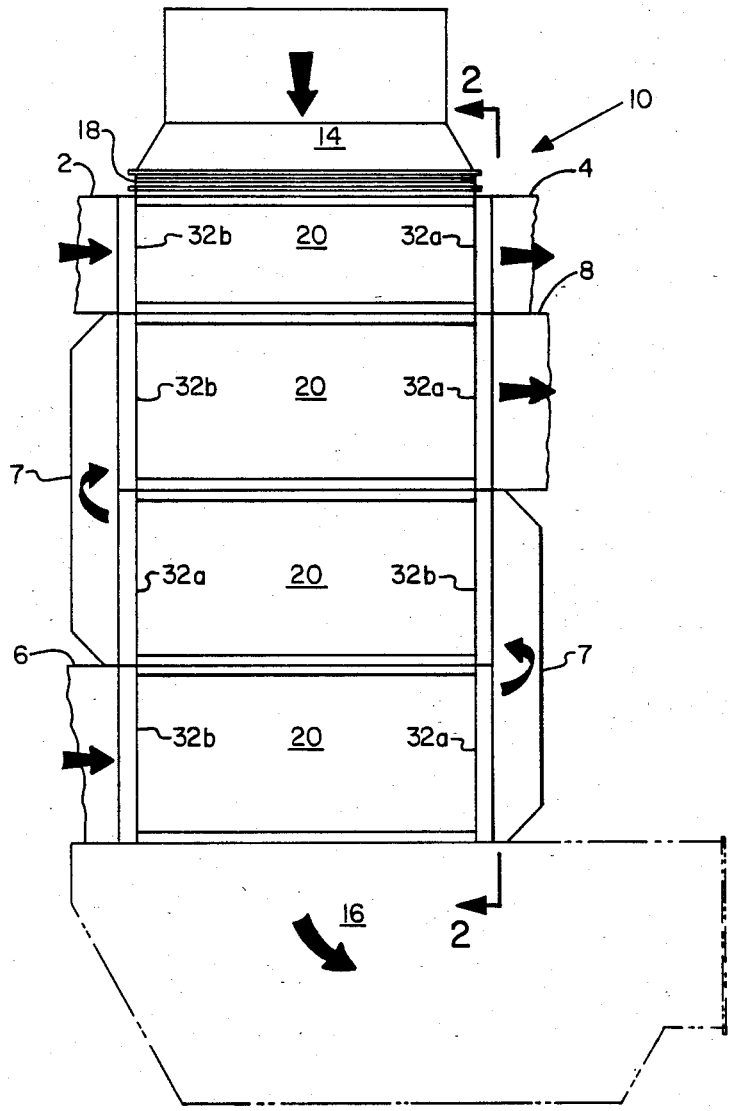
FIG. 1 is a side elevational view of a modular heat exchange apparatus formed of a plurality of pre-assembled heat exchanger modules in accordance with the present invention.
Figure 2:
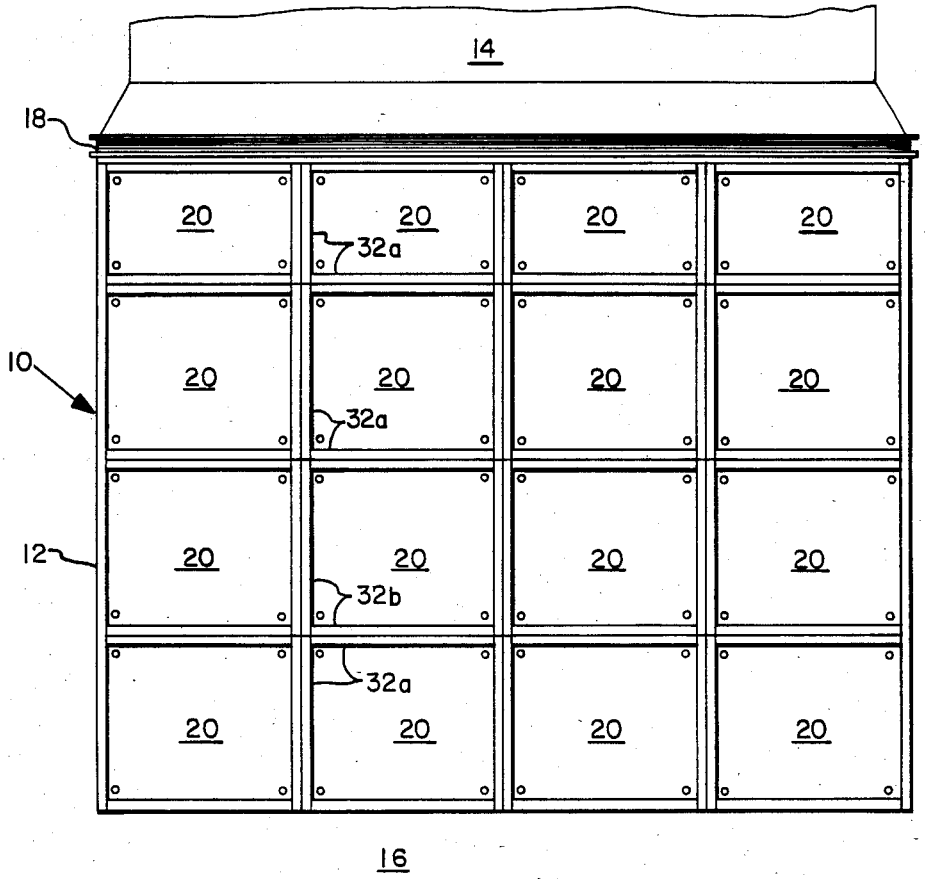
FIG. 2 is a frontal elevational view of the heat exchanger apparatus of the present invention taken along line 2—2 of FIG. 1.

Referring now to the drawing, and more particularly, FIGS. 1 and 2 thereof, there is depicted therein a modular tubular recuperative heat exchanger 10 comprised of a plurality of heat exchange modules 20 mounted together in side-by-side relationship to form a box-like array. The heat exchange modules 20 are stacked one atop the other to form columns of a desired height and a number of columns are disposed in side-by-side relationship and linked together as necessary to provide the desired heat exchange performance. A heating fluid, such as hot flue gas, flows through the box-like array 12 from a gas inlet 14 at one end thereof and out a gas outlet 16 at the opposite end thereof. In doing so, the hot flue gas traverses the individual heat exchanger modules 20 forming the box-like array 12. Each heat exchange module 20 houses a multiplicity of heat exchange tubes which provide flow passages through which the heat exchange fluid to be heated, such as combustion air, is passed in heat exchange relationship with the heating fluid passing through the stacked array of heat exchange modules 20 over the outside of the heat exchange tubes.

Although the invention is not limited thereto, the heat exchange apparatus 10 shown in the drawing is a recuperative air preheater and serves to heat air for the combustion process by passing the air in heat exchange with the hot flue gases from the combustion processes. The heat exchanger shown in the drawing is comprised of four columns and four rows of heat exchange modules 20. The uppermost row of heat exchange modules 20 serves as a single pass heat exchanger for heating secondary air. The secondary air to be heated is passed into the uppermost row of heat exchange modules 20 through inlet duct 2 and leaves the heat exchange modules 20 after having passed through the tubes therein through duct 4. The lower three rows of heat exchange modules 20 form a primary air preheater wherein the air to be heated is passed into the lowermost row of heat exchange modules 20 through inlet duct 6 and thence passes through a serpentine pass and then leaves the upper row of heat exchange modules 20 of the primary section of the air preheater through exit duct 8. Each row of heat exchange modules 20 of the primary section of the air preheater is interconnected with the row immediately below it or above it by header ducts 7 so as to form a serpentine flow path first through the heat exchange tubes of one row of modules and thence through the heat exchange tubes of the next adjacent row of modules and so on. Typically, a bellows expansion section 18 is disposed at the hot gas inlet of the heat exchanger 10 between the gas inlet duct 14 and the upper row of heat exchanger modules 20 to provide for differential expansion between the gas duct and the heat exchanger modules 20.

Figure 3:
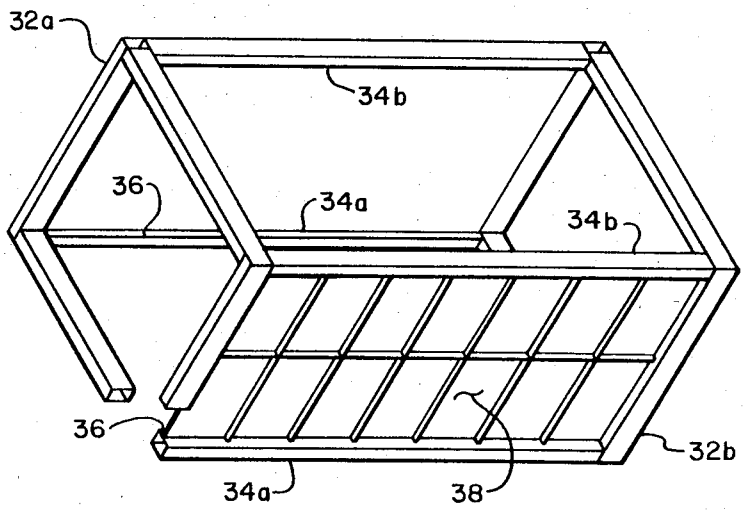
FIG. 3 is a perspective view of a support framework of an individual pre-assembled heat exchange module.
Figure 4:
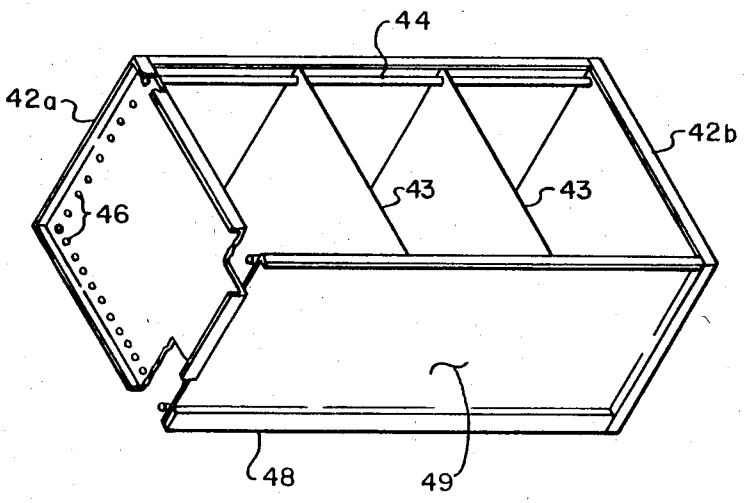
FIG. 4 is a perspective view of a tube bundle assembly of an individual heat exchange module.

In accordance with the present invention, each heat exchanger module 20 is comprised of a rectangular box-like support frame 30 and a tube bundle assembly 40 which is disposed within and mounted to the support frame 30 to form a heat exchange module 20. As best seen in FIG. 3, the rectangular box-like support frame 30 is formed of a pair of spaced end frames **32*a* and 32*b*. The end frame 32*a* and 32*b* would typically be formed of four tubular members attached together, preferably by welding, to form an integral rectangular frame. The spaced end frames 32*a* and 32*b* are interconnected at their respective corners by longitudinally elongated support members 34*a* and 34*b*. Additionally, the support members 34*a* interconnecting the lowermost corners of the end frames 32*a* and 32*b* to form the support frame 30 also provide a track surface 36 along which the tube bundle assembly 40 may be slid into and out of the support frame 30. If a particular heat exchange module is to be disposed at the sides of the heat exchanger 10, a blanking side plate 38 is welded into one side of the support frame 30 to provide a gas-tight enclosure on the side of the heat exchanger when a number of such similarly equipped frames 30 are disposed atop one another to form the sidemost row of the heat exchanger 10. The upper and lower surfaces of the support frame 30 remain open to allow the passage of gas flow through the support frame 30 and over the tubes of the tube bundle assembly 40** to be disposed therein.

The tube bundle assembly 40 of each heat exchange module 20 of the present invention is comprised of a pair of spaced tube sheets **42*a* and 42*b* and a plurality of longitudinally disposed heat exchange tubes 44 extending between aligned apertures 46 formed in the space apart tube sheets 42*a* and 42*b*. Interconnecting the lowermost corners of the spaced tube sheets 42*a* and 42*b* is a support rail 48 on each side of the tube bundle assembly 40. The support rail 48 serves not only to provide structural stiffness to the tube bundle assembly 40 but also serves as a guide rail which will abut the trackway 36 on the lowermost members 34*a* of the support frame 30 when the tube bundle assembly 40 is slid into the support frame 30. Preferably, side plates 49 are welded between the spaced apart tube sheets 42*a* and 42*b* along the lateral sides thereof to further provide structural stiffness to the tube bundle 40 and also serve as flow baffles to direct the hot gas passing through the heat exchange module 20 over the plurality of heat exchange tubes 44 disposed within the tube bundle assembly 40. Additionally, if preferred, one or more intermediate tube sheets 43 may be disposed within the tube bundle assembly 40 to further enhance the structural stiffness of the tube bundle assembly 40 and securely hold the longitudinally elongated heat exchange tubes 44 in position and prevent vibration of the elongated heat exchange tubes 44** as the hot gas flows therethrough.

Figure 5:
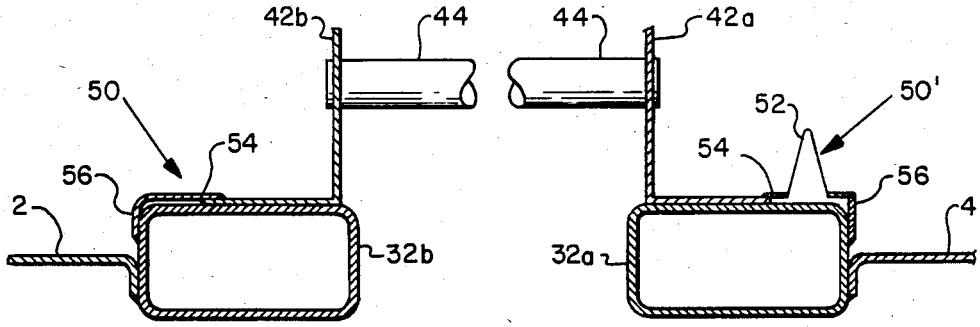
FIG. 5 is an enlarged sectional view illustrating the inner connection of the tube bundle assembly to the support framework of a heat exchange module.

To form a heat exchange module 20, the tube bundle assembly 40 is slid into the support frame 30 with the lower support rails 48 on the sides of the tube bundle assembly 40 sliding along the track 36 provided by the lowermost elongated support members **34*a* interconnecting the end frames 32*a* and 32*b* of support frame 30. Once disposed within the support frame 30, the tube bundle assembly 40 is mounted to the tube bundle assembly 30 by attachment means 50. As best seen in FIG. 5, the attachment means 50 interconnects the tube sheets 42*a* and 42*b* of the tube bundle assembly 40 respectively to the end frames 32*a* and 32*b* of the support frame 30. The attachment means 50' at at least one end of the heat exchange module 20 interconnecting the tube sheet of the tube bundle assembly 40 to the end frame 32 of the support frame 30 includes expansion means 52 for accommodating translational movement of that tube sheet relative to the end frame so that the tube bundle assembly may expand and contract freely within the support frame 30 as the heat exchange tubes 44 of the tube bundle assembly 40 expand or contract longitudinally under the influence of the hot gas flowing over the outside of the tube and the cooler combustion air being preheated which is flowing inside of the tubes 44**.

As best seen in FIG. 5, the attachment means 50 preferably comprises an L-shaped metallic strip having a first leg 54 mounted to the tube sheet 42 of the tube bundle assembly 40 and a second leg 56 mounted to the end frame member 32 of the support frame 30 adjacent to the tube sheet 42. The tube sheet **42*b* at the cold end of the tube bundle assembly 40, i.e., the end of the tube bundle assembly 40 where the air to be heated enters the tubes 44, may be attached to the end frame 32*b* at the cold end of the heat exchange module 20 by attachment means 50 which does not include any expansion means 52. However, the tube sheet 42*a* at the hot end of the tube bundle assembly 40, i.e., the end of the tube bundle assembly 40 whereat the combustion air preheated within the tubes 44 leaves the tubes 44, is mounted to the end frame 32*a* at the hot end of the heat exchange module 20 by means of attachments means 50' which does include an expansion means 52. Attachment means 52 may comprise a single or multiple accordian-like folds formed in the attachment means 50' intermediate the point of attachment of the first leg 54 to the tube sheet 42*a* and the second leg 56 to the end frame member 32*a*. Preferably, the expansion means 52 comprises a V-shaped fold in the metallic strip forming the attachment means 50' in the leg 54 which is attached to the tube sheet 42*a*. In operation, the expansion means 52 being a flexible fold will expand or contract in response to the sliding movement of the tube sheet 42*a* along the end frame 32*a* of the support frame 30 as the tubes 44 of the heat exchange bundle 40** expand or contract longitudinally under the influence of gas and air temperature differential.

When the individual heat exchange modules 20 are stacked together to form the box-like array as best seen in FIG. 2, the end frames of adjacent modules are linked together to form the structural framework of the heat exchange apparatus 10. When linked together, the support frames 30 of each of the individual modules 20 form the entire structural skeleton of the body of the heat exchange apparatus 10. Additionally, the support frames 30 of the individual heat exchange modules 20 serve to provide a shipping crate for protecting and facilitating the handling during shipment of the tube bundles 40. When it is necessary to service any of the tube bundle assemblies 40 making up the heat exchanger 10, it is merely necessary to disconnect the tube sheets 42 of the assembly to be removed from the end frame members 32 of its support frame 30 and slide the tube bundle assembly 40 therefrom without disturbing the support frame 30. The tube sheets 42 may be disconnected from their end members 32 by cutting the welds formed where the second leg 56 of the attachment means 50 is connected to the end frame 32 of the support frame 30 housing the tube bundle assembly to be removed. The tube bundle assembly may be then slid out of the support frame 30 along the track 36 formed by the lowermost support members 34 of the support frame 30. A new or refurbished tube bundle assembly 40 may be then slid back into the support frame 30 and its attachment means welded to the end frame 32 of the support frame 30 to reassemble the heat exchange module 20. Unlike other modular heat exchangers known in the prior art, the entire operation of replacing a tube bundle assembly within the heat exchange apparatus may be accomplished without in any way disturbing this structural framework and the structural integrity of the heat exchange apparatus which, in the case of the present invention, is formed by the support frames 30 in which the tube bundle assemblies 40 are disposed.

We claim:

1. A heat exchange apparatus comprising a plurality of heat exchange modules mounted together in side-by-side relationship between a gas inlet and a gas outlet to form a box-like array through which a heat exchange fluid passes in heat exchange relationship with the gas, each of said heat exchange modules comprising:

a. a rectangular box-like support frame formed of a pair of end frame members spaced apart and interconnected at their respective corners by longitudinally elongated support members, the support members interconnecting the lowermost corners of the end frames providing a track surface;

b. a tube bundle assembly disposed within said rectangular box-like support frame comprised of a pair of spaced tube sheets with aligned apertures therein and a plurality of longitudinally disposed heat exchange tubes extending between the aligned apertures in the spaced apart tube sheet providing a flow passage through which the heat exchange fluid may be passed in heat exchange relationship with the gas, said tube bundle assembly being translatable into and out of said support frame along the track surface provided by the support members interconnecting the lowermost corners of the end frames of said support frame; and c. attachment means for mounting said tube bundle assembly to said support frame, said attachment means including expansion means for accommodating translational movement of at least one tube sheet of said tube bundle assembly within said support frame as the heat exchange tubes of said tube bundle assembly expand or contract longitudinally.

2. A heat exchange apparatus as recited in claim 1 wherein said attachment means has a first leg mounted to the tube sheet of said tube bundle assembly and a second leg mounted to the end frame member of said support frame adjacent thereto with said expansion means being disposed intermediate the first and second legs of said attachment means.

3. A heat exchange apparatus as recited in claim 2 wherein said expansion means comprises at least one flexible fold formed in said attachment means intermediate the first and second legs thereof.

4. A heat exchange apparatus as recited in claim 1 wherein said attachment means comprises an L-shaped metallic strip having a first leg welded to the tube sheet of said tube bundle assembly and a second leg welded to the end frame member of said support frame laterally abutting the tube bundle assembly and including a substantially V-shaped fold therein intermediate its first and second leg, said expansion means for accommodating transitional movement of the tube sheet relative to the end frame member to which it is mounted by said attachment means.

5. A heat exchange module suitable for mounting together with a plurality of like heat exchange modules in side-by-side relationship between a gas inlet and a gas outlet to form a box-like array through which a heat exchange fluid passes in heat exchange relationship with the gas, said heat exchange modules comprising:

a. a rectangular box-like support frame formed of a pair of end frame members spaced apart and interconnected at their respective corners by longitudinally elongated support members, the support members interconnecting the lowermost corners of the end frames providing a track surface;

b. a tube bundle assembly disposed within said rectangular box-like support frame comprised of a pair of spaced tube sheets with aligned apertures therein and a plurality of longitudinally disposed heat exchange tubes extending between the aligned apertures in the spaced apart tube sheet providing a flow passage through which the heat exchange fluid may be passed in heat exchange relationship with the gas, said tube bundle assembly being translatable into and out of said support frame along the track surface provided by the support members interconnecting the lowermost corners of the end frames of said support frame; and c. attachment means for mounting said tube bundle assembly to said support frame, said attachment means including expansion means for accommodating translational movement of at least one tube sheet of said tube bundle assembly within said support frame as the heat exchange tubes of said tube bundle assembly expand or contract longitudinally.

6. A heat module as recited in claim 5 wherein said attachment means has a first leg mounted to the tube sheet of said tube bundle assembly and a second leg mounted to the end frame member of said support frame adjacent thereto with said expansion means being disposed intermediate the first and second legs of said attachment means.

7. A heat exchange module as recited in claim 6 wherein said expansion means comprises at least one flexible fold formed in said attachment means intermediate the first and second legs thereof.

8. A heat exchange module as recited in claim 5 wherein said attachment means comprises an L-shaped metallic strip having a first leg welded to the tube sheet of said tube bundle assembly and a second leg welded to the end frame member of said support frame laterally abutting the tube bundle assembly and including a substantially V-shaped fold therein intermediate its first and second leg, said expansion means for accommodating transitional movement of the tube sheet relative to the end frame member to which it is mounted by said attachment means.

* * * * *